United States Patent [19]

Grier et al.

[11] Patent Number: 4,602,392

[45] Date of Patent: Jul. 29, 1986

[54] TUB BASKET

[76] Inventors: Mildred Grier; George Spector, both of 233 Broadway, Rm 3615, New York, N.Y. 10007

[21] Appl. No.: 749,828

[22] Filed: Jun. 28, 1985

[51] Int. Cl.[4] ..... A47K 3/024

[52] U.S. Cl. ..... 4/572; 4/573; 4/579; 297/466; 297/467

[58] Field of Search ..... 4/572, 573, 571, 579, 4/575, 559, 560, 611, 604, 621, 659; 297/464, 466, 467; 220/85 K, 70; 24/17 AP, 17 B, 19; 248/74.3-74.5; 49/490; 52/716; D6/333

[56] References Cited

U.S. PATENT DOCUMENTS

| | | | |
|---|---|---|---|
| D. 227,828 | 7/1973 | Heyl | D6/333 |
| 2,229,411 | 1/1941 | Hughes | 4/572 |
| 2,285,900 | 6/1942 | Chapman | 4/572 |
| 2,460,308 | 2/1949 | Pribil | 4/572 |
| 2,468,742 | 5/1949 | Faulhaber | 4/572 |
| 2,495,482 | 1/1950 | Rogatz | 4/572 |
| 2,562,628 | 7/1951 | McPeake | 4/572 |
| 2,645,781 | 7/1953 | Mover | 4/572 |
| 2,647,561 | 8/1953 | Szabo | 4/572 |
| 3,031,229 | 4/1962 | Symbaluk | 4/572 |
| 3,295,146 | 1/1967 | Martin et al. | 4/575 |
| 3,474,781 | 10/1969 | Gaylord | 297/466 |
| 3,528,111 | 9/1970 | Chou | 4/572 |
| 3,545,016 | 12/1970 | Schorken | 4/572 |
| 3,572,830 | 3/1971 | Storer | 297/467 |
| 3,730,590 | 5/1973 | Harris | 297/466 |
| 3,767,259 | 10/1973 | Blake et al. | 297/467 |
| 3,835,483 | 9/1974 | Emery et al. | 4/579 |
| 3,918,760 | 11/1975 | Goldberg | 297/467 |
| 3,992,057 | 11/1976 | Studebaker | 297/467 |
| 4,100,628 | 7/1978 | Franzl | 4/579 |
| 4,373,221 | 2/1983 | Wilson | 4/572 |
| 4,441,221 | 4/1984 | Enste et al. | 297/464 |

*Primary Examiner*—Stephen Marcus
*Assistant Examiner*—L. J. Peters

[57] ABSTRACT

A tub basket for holding a handicaped/active child within a bathtub is provided and consists of a compact adjustable housing that fits around the body of the child reducing the space to move around in, so that the child will not fall out. The housing also has leg openings therein for the handicaped child that may have spastic legs.

3 Claims, 5 Drawing Figures

TUB BASKET

BACKGROUND OF THE INVENTION

The instant invention relates generally to safety bathing articles and more specifically it relates to a tub basket for holding a handicapped/active child within a bathtub.

Numerous safety bathing articles have been provided in prior art that are adapted to secure a child when placed in a bathtub. For example, U.S. Pat. Nos. 2,460,308; 3,031,229 and 3,528,111 all are illustrative of such prior art. While these units may be suitable for the particular purpose to which they address, they would not be as suitable for the purpose of the present invention as heretofore described.

SUMMARY OF THE INVENTION

A principle object of the present invention is to provide a tub basket for holding a handicapped/active child within a bathtub that is compact and adjustable so as to fit around the body of the child reducing the space to move around in.

Another object is to provide a tub basket for holding a handicapped/active child within a bathtub so that an attendant does not have to worry that the child will fall thus keeping the attendants hands free to bathe and remove the child in safety.

An additional object is to provide a tub basket for holding a handicapped/active child within a bathtub that contains leg openings therein for the handicapped child that may have spastic legs.

A further object is to provide a tub basket for holding a handicapped/active child within a bathtub that is economical in cost to manufacture.

A still further object is to provide a tub basket for holding a handicapped/active child within a bathtub that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
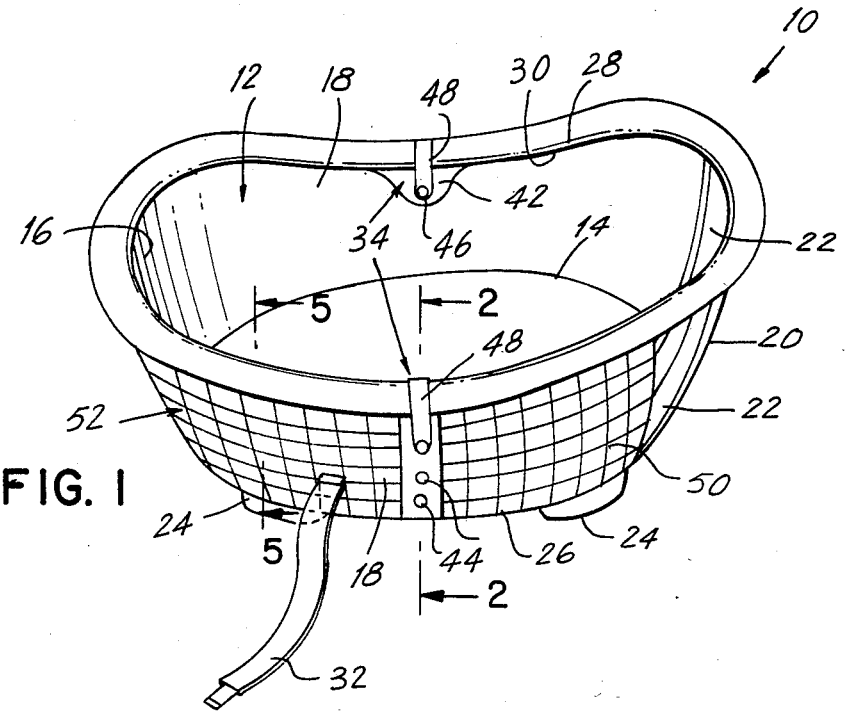
FIG. 1 is a perspective view of the invention.

Turning now descriptively to the drawings, in which similar reference characters denote similar elements throughout the several views, FIGS. 1 through 5 illustrates a tub basket 10 for holding a handicapped/active child within a bathtub (not shown).

The tub basket 10 includes a housing 12 that has a substantially horizontal flat bottom 14 with a curved substantial vertical back 16 merging into a pair of substantially vertical sides 18, 18 and a curved substantial vertical front 20 having a pair of leg openings 22, 22 therein, for the handicapped child that may have spastic legs. The vertical front 20 merges into the pair of substantially vertical sides 18, 18.

A pair of suction cups 24, 24 are affixed to underside 26 of the flat bottom 14 to secure the housing 12 to the floor of the bathtub. A padded rim 28 is around upper edges 30 of the housing 12.

A safety belt 32 is affixed to one of the sides 18 of the housing 12 which can extend across the padded rim 28 to other side 18 of the housing to snap thereto for securing a body of the child within the housing.

Figure 2:
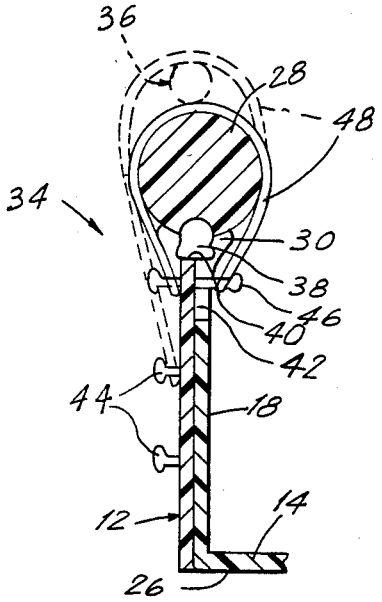
FIG. 2 is a cross sectional view taken along line 2—2 in FIG. 1 showing adjustability of the padded rim.
Figure 3:
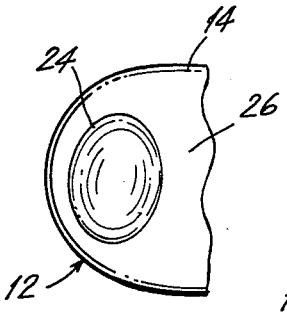
FIG. 3 is a bottom view of the base with parts removed showing one of the suction cups thereon.
Figure 4:
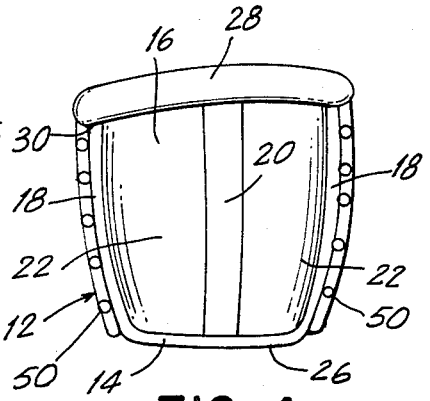
FIG. 4 is a front view thereof showing the leg openings.
Figure 5:
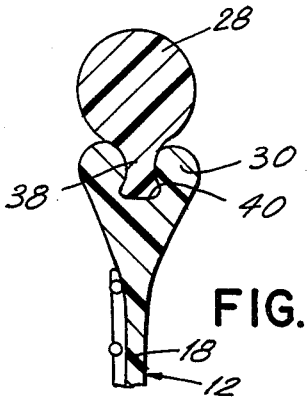
FIG. 5 is a cross sectional view taken along line 5—5 in FIG. 1 showing that the padded rim is removable.

A device 34 is provided for adjusting the padded rim 28 at middle of both sides 18, 18 of the housing 12 in front of the safety belt 32 so that arms/wrists 36 shown in dotted in FIG. 2, of the child can be comfortably placed onto the padded rim 28.

The padded rim 28 is removable from the upper edges 30 of the housing 12. It includes a tongue 38 extending downwards from underside of the padded rim to engage with the upper edges 30 that has a groove 40 therein. The padded rim 28 can be replaced when needed.

Each vertical side 18 has a middle clearance notch 42 at the upper edge 30 thereof. The device 34 includes a plurality of external knobs 44 vertically spaced apart and affixed transversely to outer surface of each vertical side 18 below the clearance notch 42.

An internal knob 46 is affixed transversely to upper inner surface of each vertical side 18 at the clearance notch 42.

A pair of elastic straps 48, 48 are used. Each strap 48 has one end affixed to the internal knob 46 and the other end removably affixed to any one of the external knobs 44. The strap 48 can pull down in various degrees the padded rim 28 into the clearance notch 42 and if so needed can hold the arm/wrist 36 of the child to the padded rim.

The housing 12 further includes a basket weave pattern 50 formed on outer surface of the back 16 and sides 18, 18 to simulate a woven basket. A water level demarcation line 52 is formed on the basket weave pattern 50 to indicate proper water level in the bathtub for bathing the child.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A tub basket for holding a handicapped/active child within a bathtub, which comprises:

(a) a housing having a substantially horizontal flat bottom with a curved substantial vertical back merging into a pair of substantially vertical sides and a curved substantial vertical front having a pair of leg openings therein for said handicapped child that may have spastic legs, said vertical front merging into said pair of substantially vertical sides;

(b) at least one suction cup affixed to underside of said flat bottom to secure said housing to floor of said bathtub;

(c) a padded rim around upper edges of said housing;

(d) a safety belt affixed to one of said sides of said housing which can extend across said padded rim to other said side of said housing to snap thereto for securing a body of said child within said housing; and (e) adjustable means for securing and restraining wrists, arms of a child on said padded rim at the middle of both sides of said housing in front of said safety belt; wherein said padded rim is removeable from said upper edges of said housing and includes a tongue extending downwards from underside of said padded rim to engage with said upper edges having a groove therein, so that said padded rim can be replaced when needed; wherein said adjustable means comprises:

(a) each said vertical side having a middle clearance notch at said upper edge thereof;

(b) a plurality of external knobs vertically spaced apart and affixed transversely to outer surface of each said vertical side below said clearance notch;

(c) an internal knob affixed transversely to upper inner surface of each said vertical side at said clearance notch; and (d) a pair of elastic straps, each said strap having one end affixed to said internal knob and other end removeably affixed to any one of said external knobs so that said strap can pull down in various degrees, said padded rim into said clearance notch and if so needed can hold said arm/wrist of said child to said padded rim.

2. A tub basket as recited in claim 1, wherein said housing further includes a basket weave pattern formed on outer surface of said back and sides to simulate a woven basket.

3. A tub basket as recited in claim 2, wherein said housing further includes a water level demarcation line formed on said basket weave pattern to indicate proper water level in said bathtub for bathing said child.

* * * * *